US005512913A

United States Patent [19]

Staney

[11] Patent Number: 5,512,913

[45] Date of Patent: Apr. 30, 1996

[54] FLAT PLATE ANTENNA, SCALER COLLECTOR AND SUPPORTING STRUCTURE

[76] Inventor: Michael W. Staney, 1551 NE. Thirteenth Ter., Suite A3, Jensen Beach, Fla. 34957

[21] Appl. No.: 227,582

[22] Filed: Apr. 14, 1994

Related U.S. Application Data

[63] Continuation-in-part of Ser. No. 913,526, Jul. 15, 1992, abandoned.

[51] Int. Cl.[6] ..... H01Q 13/00; H01Q 3/02

[52] U.S. Cl. ..... 343/781 P; 343/840; 343/882

[58] Field of Search ..... 343/781 P, 781 R, 343/878, 880, 882, 840, 912, 914, 916

[56] References Cited

U.S. PATENT DOCUMENTS

| | | | |
|---|---|---|---|
| 4,513,293 | 4/1985 | Stephens | 343/914 |
| 4,598,297 | 6/1986 | Hawkins | 343/882 |
| 4,672,385 | 6/1987 | Prindle | 343/882 |
| 4,804,970 | 2/1989 | Todd | 343/753 |
| 4,819,007 | 4/1989 | Tezcan | 343/882 |
| 4,825,223 | 4/1989 | Moore | 344/914 |
| 4,980,697 | 12/1990 | Eklund | 343/882 |

FOREIGN PATENT DOCUMENTS

| | | | |
|---|---|---|---|
| 3200731 | 7/1983 | Germany | 343/481 P |
| 0081706 | 5/1982 | Japan | 343/840 |

*Primary Examiner*—Donald T. Hajec
*Assistant Examiner*—Tan Ho
*Attorney, Agent, or Firm*—McHale & Slavin

[57] ABSTRACT

An flat panel antenna for reflecting several microwave frequencies without adjusting to maximize frequency gain. Reflector surfaces propagate from a central axis and using declining inclined surfaces that focus reflected signals into a scaler collector set at a predetermined focal point from the surface of the panel. The shape of the antenna reflect signals with different frequencies by delay so that the scaler collector can process the signals separately.

24 Claims, 4 Drawing Sheets

FLAT PLATE ANTENNA, SCALER COLLECTOR AND SUPPORTING STRUCTURE

This is a continuation-in-part of application Ser. No. 07/913,526 filed on Jul. 15, 1992, now abandoned.

BACKGROUND OF THE INVENTION

1. Field of the Invention

The present invention relates to antennas and more particularly to flat panel microwave antennas.

2. Background Information

Satellite antennas of the prior art are easily recognized by their parabolic design. These large and unsightly items can be found throughout the world for communication purposes. The parabolic type shapes range anywhere from 5 to 20 feet in diameter requiring industrial mounts to prevent damage during wind storms due to poor aerodynamic qualities. The conventional satellite dish is typically constructed of metal which is expensive to manufacture and costly to ship.

The purpose of the parabolic type geometry is to ensure reflection and collection of signals at a particular point in space a distance from the inner surface of the antenna used for processing. The common inclination was to use large satellite dishes in order to collect a larger sampling of microwave signals for subsequent processing. For these reasons the common practice has been to manufacture as large of antenna dish as possible using such technology as collapsible dishes and mesh steel dishes for purposes of lowering manufacturing and/or shipping costs.

Many present day satellite communication networks now rely upon a signal beam of highly directive length wherein a refractive type structure is preferable to the aforementioned parabolic reflector type structure. Reflective microwave structures serve to focus the microwave onto a collector set a predetermined distance from the surface of the refractive structure. One such surface refractive antenna lens is disclosed in U.S. Pat. No. 2,547,416 to Skellett which discloses a series of adjacent dielectric rings each having a surface contour of various thickness so as to produce a series of phase delays at a prescribed frequency to produce an emergent wave front. This dielectric antenna presents a complex manufacturing problem having angles that are too sharp and requirements that each ring be machined from a given thickness of material thereby making the cost of manufacturing expensive in term of complexity and weight for the supporting structure.

Another refractive antenna is disclosed in U.S. Pat. No. 4,804,970 issued to Todd which sets forth a multiple wave length conversion arrangement employing dielectric lens in combination with the wavelength selective filter. This enables the antenna to be used as a part of a compact microwave transceiver unit operating on various frequencies. Todd sets forth a convex center piece with a sawtooth type adjacent rings having incline termination edges as they radiate out from the center section of the antenna using squared off ridges.

Another microwave reflector assembly is disclosed in U.S. Pat. No. 4,825,223 issued to Moore. Moore discloses a light weight reflected assembly constructed from a sequence of reflective surfaces using a convex center with a plurality of radiant reflective arrays creating a focal point having gain which is proportional to the radial of the diameter of the parabola divided by the wavelength of the frequency being received. The Moore patent does not disclose radiating reflectors of decreasing height, size, or use of a top member. The reflectors of decreasing height relies upon multiple focal points that require the device to be moved in order to focus to each focal point.

U.S. Pat. No. 4,513,293 issued to Stephens sets forth a frequency selective antenna that teaches away from the use of declining ridges by disclosing the use of all ridges conforming to the same horizontal plane.

Flat plate collectors in the prior art lose energy as the source moves relative to the collector. The antenna with tis reflective mirrors must move in the direction of the source of the transmissions, such as a satellite, in order to receive a strong signal. This movement offsets the remaining frequencies thereby requiring the mirror to be repositioned for each additional frequency selected. This movement offsets the remaining frequencies thereby requiring the mirror to be repositioned for each additional frequency selected. Thus, what is needed in the art is a flat plate array type antenna capable of recording level power signals despite the variance in frequency and an antenna that will adjust to a satellite transmission by simply tilting of the antenna.

SUMMARY OF THE INVENTION

The apparatus disclosed consists of a composite plate structure which serves to contain highly reflective surfaces that act as a reflective mirror for reflecting frequencies that range from ⅓ wavelength at the highest frequency to ½ wavelength at the lowest frequency providing an orderly progression as the frequency elevates or declines thereby retarding these wavelengths to create gain.

This reflective surfaces are convoluted using an array type pattern which can focus microwave wavelengths to a predetermined focal point above the upper containment structure. A matching scaler collector placed at the focal point translates the wavelengths in phase, thus the power signal levels are substantially the same for each frequency examined providing a matching collection of waves according to the antenna design.

The reflecting surface consists of a first circular reflective surface with a centrally disposed convex shaped depression placed along a common axis and positioned to reflect signals from an upper surface of said reflective surface to the scaler collector. The first reflective surface having a raised edge placed along a first horizontal plane defining a border thereto. A second reflective surface is integrated into the first reflective surface and concentrically surrounds the first reflective surface placed along the same common axis and having an inclined angle to reflect signals from an upper surface of the reflective surface to the scaler collector. A second raised edge placed beneath the first horizontal plane defines a border thereto along a second horizontal plane. A third reflective surface on the mirror concentrically surrounds a portion of the second reflective surface placed along said common axis and also has an inclined angle to reflect signals from an upper surface to the scaler collector. A third raised edge placed beneath the second horizontal plane defines a border thereto along a third horizontal plane. A fourth reflective surface concentrically surrounds a portion of the third reflective surface along said common axis and further has an inclined angle to reflect signals from an upper surface to the scaler collector and a fourth raised edge placed beneath the third horizontal plane defining a border thereto along a fourth horizontal plane. A primary function of the fourth reflective surface is to prevent sagging of the remaining reflective surface by providing corner support.

A monolithic containment housing provides protection and maintains accuracy of the reflective surfaces in an outdoor setting. The housing surrounds the reflective surfaces and couples to a rotatable movable ground member.

Accordingly, a primary objective of the instant invention is to provide an improved microwave antenna by use of a low cost weather resistant reflective surface consisting of a series of outwardly extending inclined reflective surfaces having descending leading edges providing an orderly collection of wavelength signals despite frequency changes.

Still another objective of the instant invention is to teach the use a mirrorized aluminum film coating of plastic for microwave reflection providing a reduced cost in manufacture and weight providing a longevity of surface reflection.

Yet still another objective is to teach corner end support of reflecting surfaces so as to allow the use of less costly construction materials while preventing sagging of reflecting surfaces.

The above-stated objectives as well as other objectives which, although not specifically stated, are intended to be included within the scope of the present invention, are accomplished by the present invention and will become apparent from the hereinafter set forth Detailed Description of the Invention, Drawings, and the Claims appended herewith.

DETAILED DESCRIPTION OF THE INVENTION

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
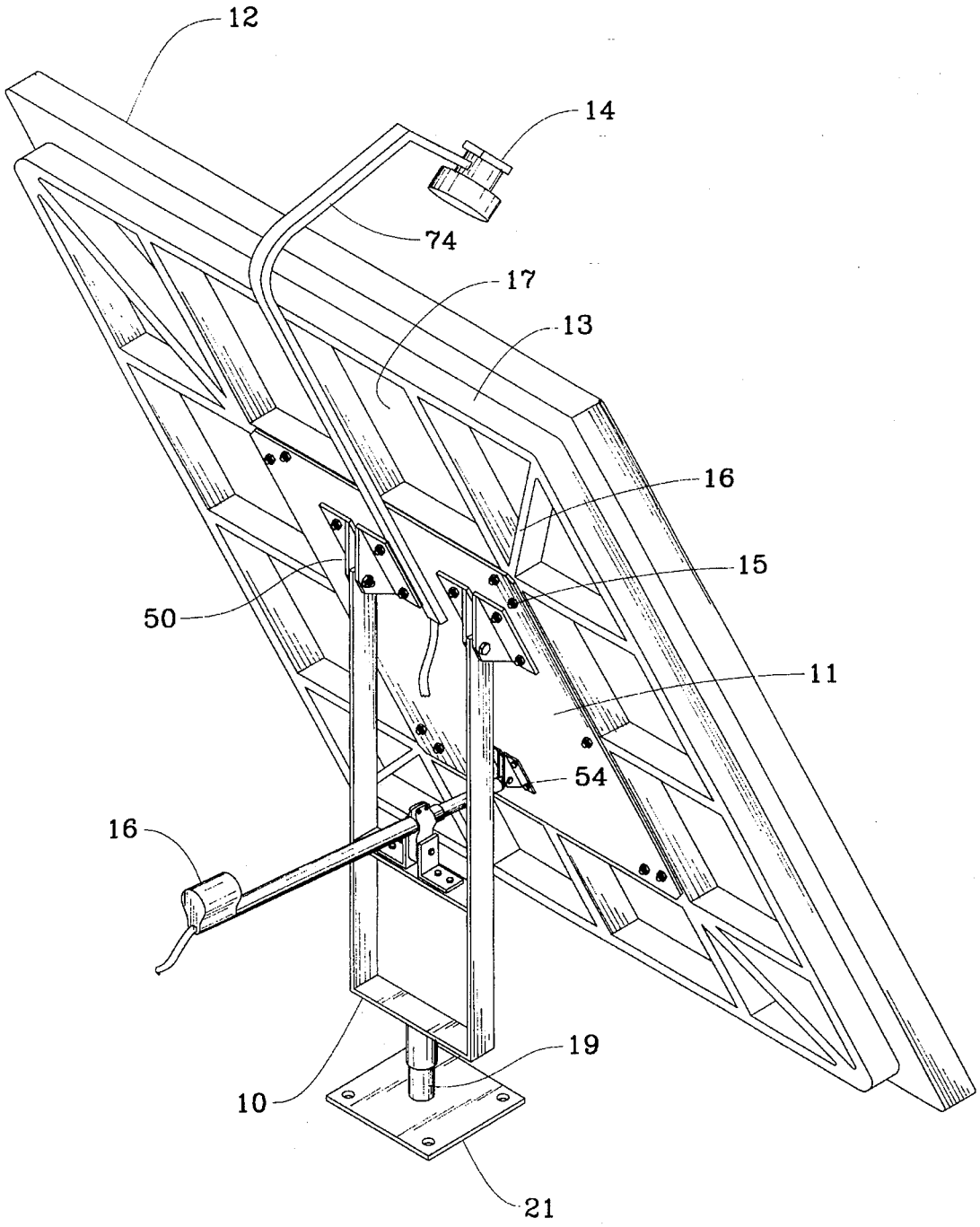
FIG. 1 is a flat plate antenna being supported by a stand and the scaler collector in place.

Referring to FIG. 1, a flat plate antenna 12 is mounted to an antenna stand 10 by use of a metal plate 11 secured to a support base 13 of the antenna by use of mounting bolts 15. The base 13 of the antenna includes structural support members 16 providing a rigid support to backing sheet 17. The support base 13, support members 16 and backing sheet 17 are constructed of molded plastic or the like material providing a lightweight support structure. Two brackets 50 are coupled to the upper portion of the flat plate providing pivotal support with a lower bracket 54 pivotally connected to the lower portion of flat plate 11 having a motorized actuator 16 to cause rotation by remote activation. A scaler collector 14 is positioned 23.4 inches above the surface of the flat plate antenna by a support arm 74.

The motorized actuator 16 is a hydraulic pump type such as that known as the Universal D.C. Control Actuator. This type of actuator has an inner tube which moves in or out of an outer tube to give the proper angle to the flat plate antenna. The antenna stand can swivel along a junction 19 relative to the ground plate 21 which allows the azimuth angle of the flat plate antenna to be rotated to the proper direction.

Figure 2:
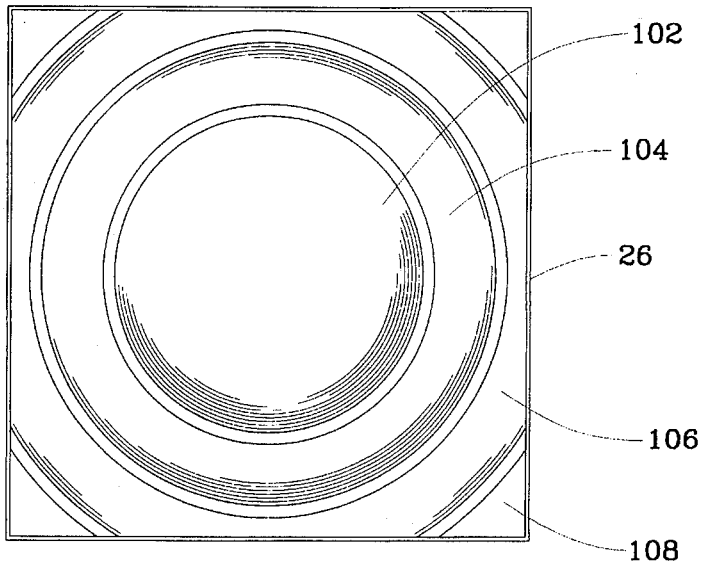
FIG. 2 is a top view of the flat plate antenna.

Referring to FIG. 2, a top view of the flat plate antenna is shown. The reflective mirror in this embodiment is constructed from single pieces of vacuum formable plastic such as acrylic having a series of reflecting mirror-like surfaces. These surfaces reflect signals with frequencies in the microwave spectrum.

The length and depth of each reflective surface is based on one wavelength. Unlike earlier antenna designs, which relied on a depth of a half wavelength across the entire frequency spectrum, this invention achieves the same purpose by increasing the depth to one wave length. Because of this increase in the depth, the number of reflective surfaces is decreased and surface area based on the distance from the focal point is increased. This design reduces the noise while contributing to an increase in overall gain. Gain is further enhanced by the reflective surface maintaining a tolerance of less than 0.020 RMS, which is achieved through uniformly controlled surface deposition of the reflecting material to the surface of the acrylic mirror.

In the preferred embodiment, the physical dimensions of the flat antenna are as follows. As viewed from the top, the first reflective surface 102 has a radius of 18.5 inches. The outer reflective surfaces are inclined toward the center. The second concentric reflective surface 104 has an incline length of 8.75 inches. The third concentric reflective surface 106 has an incline length of 7.50 inches. The fourth concentric reflective surface 108 has an incline length of 6.75 inches. The overall height of these inclined reflective surfaces is around 3 inches with the overall preferred antenna cut just less than 60 inches square. The fourth reflective surface operates to prevent declining angles from shifting.

Figure 3A:
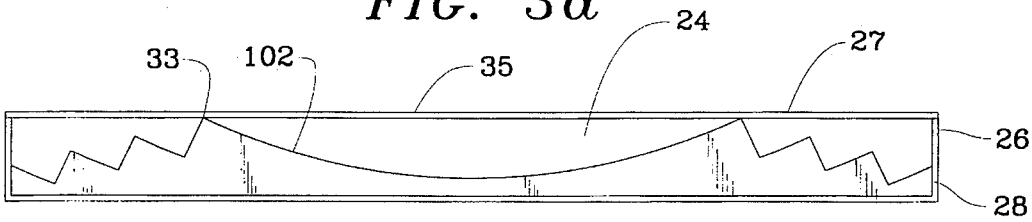
FIG. 3*a* is a side view of the flat plate antenna.

As can be seen by reviewing FIG. 3*a*, each reflective surface has its lowest point closer to the center of the panel and inclines upward to reach the height of 3.2 inches. Since each surface has a different length, the fourth concentric reflective surface 108 has a steeper incline than the first concentric reflective surface 104. This incline angle difference is designed to focus the signals toward the scaler collector which will be described below.

These concentric circles are mounted in a monolithic containment structure 26. This containment structure has a top plate 27 and a bottom plate 28. The top plate is constructed from a microwave transparent vinyl film such as Sintra Alncobond which is capable of allowing signals to pass without interference. The bottom plate is constructed of rigid plastic such as urethane epoxy resin sold under the trademark of KOMATEX or ABS plastic using a triangular shaped angles for rigid support. A filler 24, such as an insulation material sold under the name of Sentinel F-cell polyethylene foam, is used to fill the gaps between the mirror surfaces and the top plate. This containment structure 26 provides weather proof outdoor protection and maintains accuracy of the mirrored surface reflection.

The final dimensions of the flat panel antenna, as described in this preferred embodiment, is approximately 5 feet square and about 3.5 inches in depth with a first circular reflective surface 102 having a centrally disposed convex shaped depression placed along a common axis and positioned to reflect signals from the surface 102 to a predetermined focal point. The reflective surface 102 having a raised edge 33 placed along a first horizontal plane 35 defining a border thereto with a distance of approximately 2.95 inches between the lowest portion surface 102 depression and the plane 35 formed by the raised edge 33.

Figure 3B:
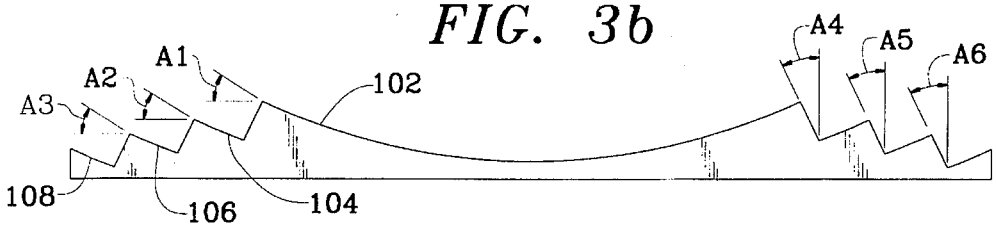
FIG. 3*b* is a side view of the flat plate antenna depicting angular offsets.

FIG. 3*b* sets forth the inclined angle of the reflective surfaces. The first reflective surface 102 having an angle A1 of approximately 16 degrees; the second reflective surface 104 having an angle A2 of approximately 21.4 degrees; the third reflective surface 106 having an angle A3 of approximately 25 degrees. Descending edge slope from the first reflective surface 102 to the second reflective surface 104 has an angle A4 of approximately 72 degrees. The second reflective surface 104 to the third reflective surface 106 has an angle A5 of approximately 66 degrees. The third reflective surface 106 to the forth reflective surface 108 also has an angle A6 of approximately 66 degrees.

Figure 3C:
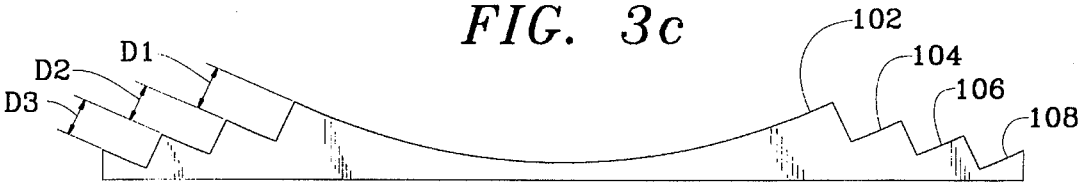
FIG. 3*c* is a side view of the flat plate antenna depicting the dimensions between each antenna plate.

FIG. 3*c* depicts the distance between the reflective surfaces, reflective surface 102 having a distance D1 between reflective surface 104 of approximately 3 inches. Reflective surface 104 having a distance D2 between reflective surface 106 of approximately 3 inches. Reflective surface 106 having a distance D3 between reflective surface 108 of approximately 3 inches.

Figure 3D:
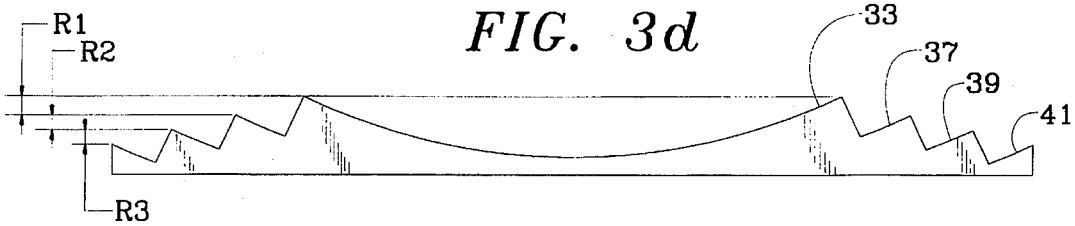
FIG. 3*d* is a side view of the flat plate antenna depicting the raised level of each plate.

FIG. 3*d* depicts the distance between horizontal planes as defined by each surface raised ridge providing a border. The second raised ridge 37 having a ridge height R1 placed approximately 0.25 inches lower than the first ridge 33. The third raised ridge 39 having a ridge height R2 placed approximately 0.25 inches lower than the second ridge 37. The fourth raised ridge 41 having a ridge height R3 placed approximately 0.25 inches lower than the third ridge 37. The surface accuracy provided by the extruded acrylic mirror along with the deposition of an uniform thickness of mirrorized aluminum film, yield superior results over past reflective surfaces. This process design eliminates previous short comings encountered in applications involving solar collection and satellite television technologies and is typically coated with lacquer.

Figure 4:
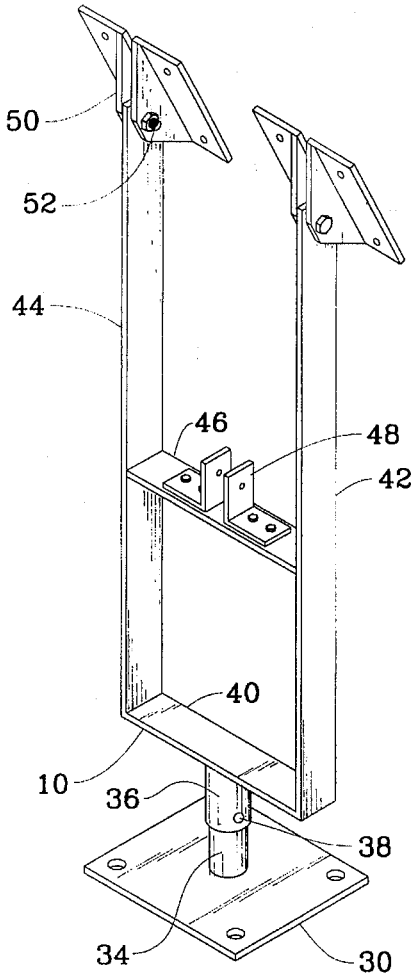
FIG. 4 is a perspective view of the antenna stand.

Referring to FIG. 4, an antenna support for the flat panel antenna is shown. A stand 10 can be mounted on a building's wall or roof or can be mounted on the ground such as a driveway or patio. The stand has two parts. A flat platform member 30 which has holes for screws or bolts to attach to flat surfaces and an inner tubular member 34 which is mounted perpendicular to the flat platform member. An outer tubular member 36, which has a slightly larger diameter than the inner tubular member 34, has two holes for bolts 38 on opposite sides of the diameter of the tube. The outer tubular member slides over the inner tubular member and the bolts 38 are tightened until the ends of the bolt touch the inner tubular member.

The midpoint of a bottom cross member 40 is attached to the top end of the outer tubular member. One side support 42, 44 is attached to each end of the bottom cross member. Near the top portion of the side support is a hole for a self lubricating bushing 50. The bushing holds two panel brackets which are free to pivot. The panel brackets are later attached to the flat panel. The ends of a top cross member 46 are attached to the middle portion of the side supports 42, 44. The middle section of the top cross member has holes to hold angle brackets 48 which support the motorized actuator.

Once the flat panel antenna is attached to the stand, then the outer tubular member is moved to rotate the panel to the proper azimuth angle. The motorized actuator 16 is then used to give the proper vertical angle by elevating or lowering the flat panel antenna into position. Once the scaler collector 14 is in place, then the antenna is ready to receive transmissions.

Figure 5:
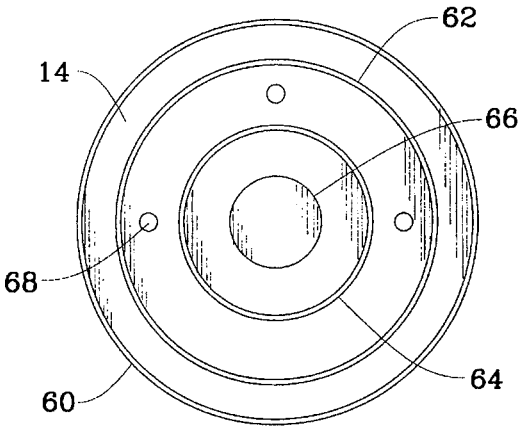
FIG. 5 is a top sectional view of the scaler collector for collection and processing of signals reflected by the reflecting surface

In FIG. 5, a top sectional view of the preferred embodiment of the scaler collector is shown. In the preferred embodiment, this scaler collector is mounted 23.4 inches above the flat panel antenna.

Figure 6:
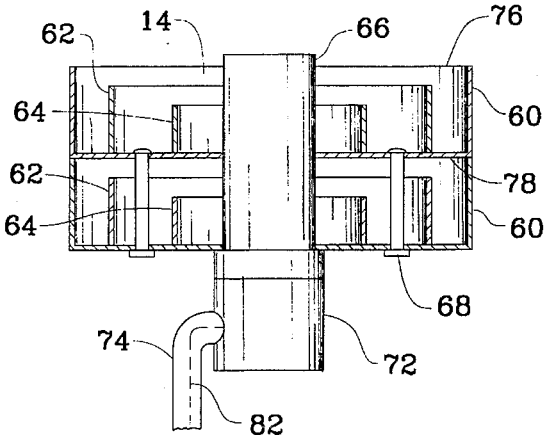
FIG. 6 is a side sectional view of the scaler collector shown with recessed matching reflective surface

Referring to FIG. 6, the collector is made of two identical cylindrical casings 60 where the first casing is stacked on top of the second casing. The casing is made of an aluminum alloy such as 383 Aluminum Alloy. Each casing consists of a bottom circular sheet 78 with a diameter of about 6.5 inches and a thickness of 0.25 inches. The side wall 60 has a total height of 2.69 inches. A top circular plate 76 encloses the casing and has approximately the same dimensions as the bottom plate. The top and bottom plates have a 2.615 inch diameter hole in the center for a cylindrical wave guide tube 66. Inside the casing are two concentric rings attached to the bottom plate. The outer ring 62 has a diameter of around 4.55 inches and a height of 1.065 inches. The inner ring 64 has a diameter of 2.755 inches and a height of 0.9 inches.

The two casings are attached by bolts 68. The cylindrical wave guide tube 66 runs through the center of both casings to attach to an amplifier 72. A support arm 74 supports the scaler collector above the flat plate antenna. A wire 82 sends signals from the amplifier to a receiver (not shown).

This scaler collector evenly collects all frequencies by translating the wavelengths that arrive retarded by the flat plate antenna's reflection to a central focal point. Collectors of this type in past history would translate this microwave frequency but at a loss requiring movement of the reflective mirror in order to receive maximum power or signal reception at this point. This required movement offset the remaining frequencies and thereby required the mirror to be repositioned for each additional frequency selected. Due to the unique design of the flat panel antenna, this invention does not require this peaking movement of the antenna as did previous antennas.

Figure 7:
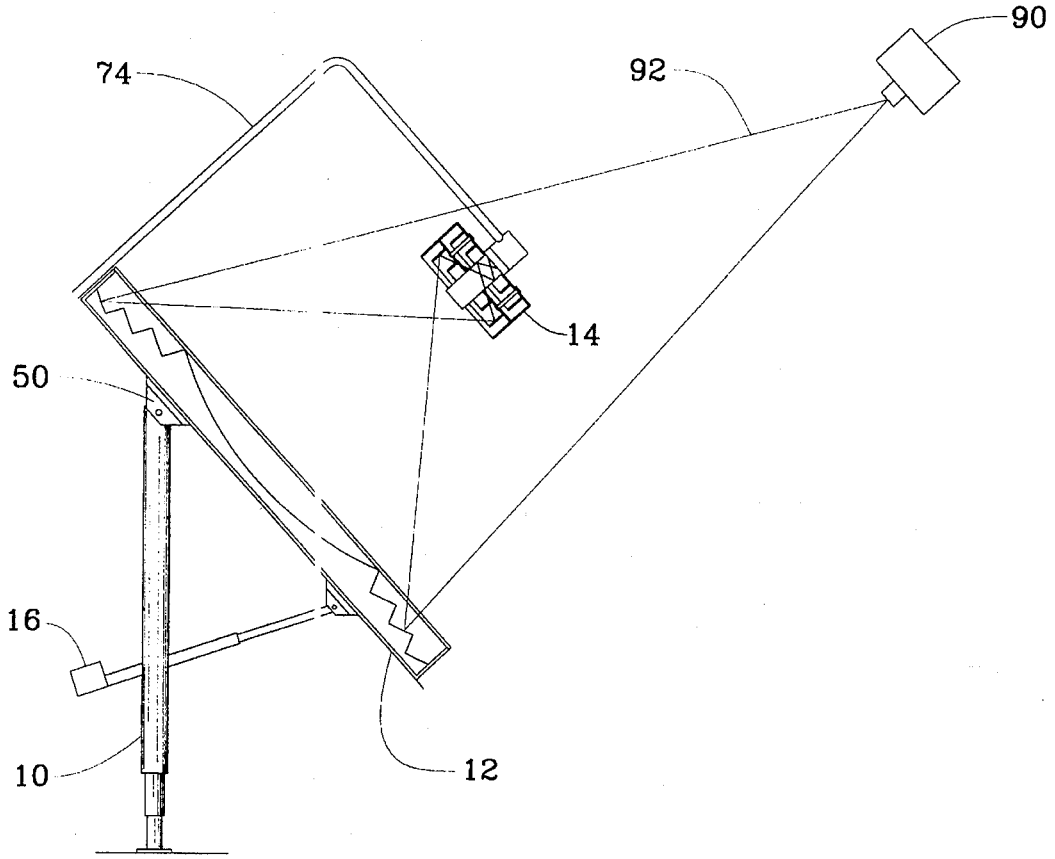
FIG. 7 shows the operation of the flat plate antenna and the scaler collector and FIG. 8 shows the flat plate antenna having a cover installed over tho reflecting surface.

Referring to FIG. 7, microwave signals 92 are beamed to the flat plate antenna 12 from a satellite 90. The signals with different wavelengths reflect off the reflective surfaces and the signals with the correct wavelengths are focused toward the scaler collector 14. The signals are then reflected off the rings in the scaler collector and enter the wave guide tube. The tube directs the signals toward the amplifier. The amplified signal is then sent to a receiver to be processed.

As the microwaves are reflected off the reflective surfaces of the flat plate antenna, a delay occurs due to the varied distances from the antenna's reflecting surface to the scaler collector. With this design, an orderly progression of waves are sent to the scaler collector. Waves of different frequencies reach the collector at slightly different times so that each signal can be read separately. The retarding of these wavelengths creates gain but unlike other reflectors of this type which use successive ½ wavelength retardation, this invention uses a succession of wavelengths to achieve frequency reception that does not rely on mirror movement to achieve the results of performance.

Figure 8:
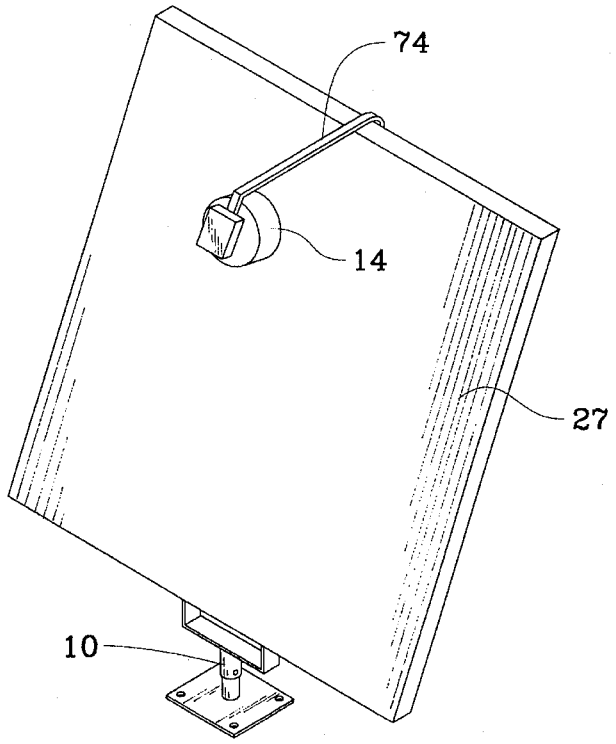

Superior performance in satellite reception is realized in the aspects of reduction of size in surface area and the elimination of stepped ½ wavelength elevations on a plane surface to cover the intended frequency spectrum. This along with deletion of mirror movement per frequency selected make this particular design outstanding in this category. FIG. 8 sets forth the flat plate antenna having the top plate 27 of microwave transparent vinyl film which allows signals to pass through the plate without interference providing protection to the reflective surfaces from the elements. The antenna is mounted to stand 10 which further supports the collector 14 by means of the bracket 74.

It should be understood that the foregoing relates to only preferred embodiments of the present invention, and that it is intended to cover all changes and modifications of the embodiment of the invention herein used for the purposes of disclosure, which do not institute departures from the spirit and scope of the invention.

What is claimed is:

1. A flat plate antenna for receiving microwave signals comprising:

a first circular reflective surface with a centrally disposed convex shaped depression placed along a common axis and positioned to reflect signals from an upper surface of said reflective surface to a predetermined focal point, said first reflective surface having a raised edge placed along a first horizontal plane defining a border thereto;

a second reflective surface concentrically surrounding said first reflective surface placed along said common axis and having an inclined angle to reflect signals from an upper surface to said predetermined focal point and a second raised edge placed beneath said first horizontal plane defining a border thereto along a second horizontal plane;

a third reflective surface concentrically surrounding at least a portion of said second reflective surface placed along said common axis and having an inclined angle to reflect signals from an upper surface to said predetermined focal point and a third raised edge placed beneath said second horizontal plane defining a border thereto along a third horizontal plane;

a fourth reflective surface concentrically surrounding at least a portion of said third reflective surface placed along said common axis and having an inclined angle to reflect signals from an upper surface to said predetermined focal point and a fourth raised edge placed beneath said third horizontal plane defining a border thereto along a fourth horizontal plane;

a matching scaler collector positioned at said focal point having a means for phasing microwave signal;

a containment structure which surrounds said first, second, third and fourth reflective surfaces, said containment housing having a top member;

a support member holding said containment structure and said scaler collector; and a means for rotating said containment structure and said scaler collector in respect to said support member.

2. The antenna according to claim 1 wherein said containment structure is constructed of plastic having structural reinforcement in the shape of triangular angles integrated therein.

3. The antenna according to claim 2, wherein said structural reinforcement includes a means to prevent sagging of said reflective surfaces.

4. The antenna according to claim 1 wherein polyurethane foam is used to fill free air space between an inner surface of said containment structure and an inner surface of said reflective surfaces.

5. The antenna according to claim 1 wherein focal point is 23.4 inches above the first horizontal plane in said common axis.

6. The antenna according to claim 1, wherein a radial dimension of each of said reflective surfaces is equal to one wave length of pre-determined microwave signals.

7. The antenna according to claim 1 wherein said reflective surfaces are constructed from a single piece of vacuum formed plastic having a reflecting material placed thereon.

8. The antenna according to claim 1 wherein said inclined angle of said first reflective surface is set at 16 degrees to said first horizontal plane and acutely inclined to said common axis toward said focal point.

9. The antenna according to claim 1 wherein said inclined angle of said second reflective surface is set at 21.4 degrees to said second horizontal plane and acutely inclined to said common axis toward said common focal point, said second raised edge is 0.25 inches beneath said first horizontal plane.

10. The antenna according to claim 1 wherein said inclined angle of said third reflective surface is set at 25 degrees to said third horizontal plane and acutely inclined to said common axis toward said common focal point, said second raised edge is 0.25 inches beneath said second horizontal plane.

11. The antenna according to claim 1 wherein said inclined angle of said fourth reflective surface is acutely inclined to said common axis toward said common focal point and 0.25 inches beneath said third horizontal plane, said fourth reflective surface prevent said first, second and third reflective surfaces from sagging.

12. The antenna according to claim 1 wherein said scaler collector matches said reflective surfaces and is defined by a circular ring;

a flat circular top member, which has a central hole, attached to top portion of circular ring;

a flat circular middle member, which has a central hole, attached to an inner middle portion of circular ring;

a flat circular bottom member, which has a central hole, of said flat circular top member, said hole of said flat circular middle member and said hole of said flat circular bottom member;

a first inner ring attached perpendicularly to a top portion of said flat circular middle member;

a second inner ring, which has a smaller diameter than said first inner ring, attached perpendicularly to a top portion of said flat circular bottom member, said second inner ring being concentric to said first inner ring;

a third inner ring, which has a substantially the same diameter as said first inner ring, attached perpendicular to a top portion of said flat circular bottom member; and a fourth inner ring, which has a substantially the same diameter as said second inner ring, attached perpendicularly to a top portion of said flat circular bottom member, said fourth inner ring being concentric to said third inner ring.

13. The antenna according to claim 1 wherein said scaler collector is defined as a top circular casing having a top portion with a central hole, a bottom portion with central hole, and outside circular wall connecting the outer edge of said top portion with outer edge of said bottom portion, a large inner ring attached to said bottom portion with a height less than said outer circular wall, and a small inner ring attached to said bottom portion, said small inner ring being concentric to said large inner ring, and which has a smaller diameter and smaller height than said large inner ring;

a bottom circular casing, which is located below said top circular casing, having a top portion with a central hole, a bottom portion with central hole, an outside circular wall connecting the outer edge of said bottom portion, a large inner ring attached to said bottom portion with a height less than said outer wall, and a small inner ring attached to said bottom portion, said small inner ring being concentric to said large ring and which has a smaller diameter and smaller height than said large inner ring;

a connecting means for connecting said top circular casing to said bottom circular casing; and a circular wave guide tube positioned in central holes of said top circular casing and said bottom circular casing.

14. The antenna according to claim 1 wherein said reflective surface is coated with a mirrorized aluminum film.

15. A scaler collector for receiving signals reflected from a flat panel antenna comprising:

a circular ring;

a flat circular top member, which has a central hole, attached to a top portion of said circular ring;

a flat circular middle member, which has a central hole, attached to an inner middle portion of said circular ring;

a flat circular bottom member, which has a central hole, attached to a bottom portion of said circular ring;

a circular wave guide tube which passes through said hole of said flat circular top member, said hole of said flat circular middle member and said hole of said flat circular bottom member;

a first inner ring attached perpendicularly to a top portion of said flat circular middle member;

a second inner ring, which has a smaller diameter than said first inner ring, attached perpendicularly to a top portion of said flat circular middle member, said second inner ring being concentric to said first inner ring;

a third inner ring, which has substantially the same diameter as said first inner ring, attached perpendicularly to a top portion of said flat circular bottom member; and a fourth inner ring, which has substantially the same diameter as said second inner ring, attached perpendicularly to a top portion of said flat circular bottom member, said fourth inner ring being concentric to said third inner ring.

16. A scaler collector as claimed in claim 15, wherein an amplifier is attached to a bottom portion of said circular wave guide tube.

17. A scaler collector as claimed in claim 16, wherein a support arm is attached to said amplifier to support the scaler collector above said flat panel antenna.

18. A scaler collector as claimed in claim 15, wherein a support arm is attached to said circular ring to support the scaler collector above said flat panel antenna.

19. A scaler collector as claimed in claim 15, wherein said scaler collector is made from an aluminum alloy.

20. A scaler collector for receiving signals reflected from a flat panel antenna comprising:

a top circular casing having a top portion with a central hole, a bottom portion with central hole, an outside circular wall connecting the outer edge of said top portion with outer edge of said bottom portion, a large inner ring attached to said bottom portion with a height less than said outer circular wall, and a small inner ring attached to said bottom portion, said small inner ring being concentric to said large inner ring, and which has a smaller diameter and smaller height than said large inner ring;

a bottom circular casing, which is located below said top circular casing, having a top portion with a central hole, a bottom portion with central hole, an outside circular wall connecting the outer edge of said top portion with outer edge of said bottom portion, a large inner ring attached to said bottom portion with a height less than said outer wall, and a small inner ring attached to said bottom portion, said small inner ring being concentric to said large inner ring and which has a smaller diameter and smaller height than said large inner ring;

a connecting means for connecting said top circular casing to said bottom circular casing; and a circular wave guide tube positioned in central holes of said top circular casing and said bottom circular casing.

21. A scaler collector as claimed in claim 20, wherein an amplifier is attached to a bottom portion of said circular wave guide tube.

22. A scaler collector as claimed in claim 21, wherein a support arm is attached to said amplifier to support the scaler collector above said flat panel antenna.

23. A scaler collector as claimed in claim 20, wherein a support arm is attached to said outside circular wall to support the scaler collector above said flat panel antenna.

24. A scaler collector as claimed in claim 20, wherein said scaler collector is made from an aluminum alloy.

* * * * *